US009387143B1

(12) United States Patent
Horton

(10) Patent No.: US 9,387,143 B1
(45) Date of Patent: Jul. 12, 2016

(54) TWO-PIECE CASKET COVER FOR IN-GROUND BURIAL

(71) Applicant: Allan Horton, Manorville, NY (US)

(72) Inventor: Allan Horton, Manorville, NY (US)

( * ) Notice: Subject to any disclaimer, the term of this patent is extended or adjusted under 35 U.S.C. 154(b) by 0 days.

(21) Appl. No.: 15/005,238

(22) Filed: Jan. 25, 2016

Related U.S. Application Data

(60) Provisional application No. 62/107,708, filed on Jan. 26, 2015.

(51) Int. Cl.
*A61G 17/02* (2006.01)
*A61G 17/04* (2006.01)

(52) U.S. Cl.
CPC ..... *A61G 17/02* (2013.01); *A61G 17/04* (2013.01); *A61G 2017/048* (2013.01)

(58) Field of Classification Search
CPC ..... A61G 17/00; A61G 17/02; A61G 17/04; A61G 2017/048; E04H 13/001; B60J 11/00; A47C 31/10
USPC ..... 27/19, 35; D99/12; 150/158, 166; 52/128, 133
See application file for complete search history.

(56) References Cited

U.S. PATENT DOCUMENTS

| | | | | |
|---|---|---|---|---|
| 776,500 | A | 12/1904 | De Long | |
| 1,719,364 | A * | 7/1929 | Gilkey | A61G 17/00 190/27 |
| 2,508,319 | A | 12/1948 | Westenhaver | |
| 3,066,379 | A | 12/1962 | Meeks | |
| 3,103,053 | A | 9/1963 | Hollis | |
| 3,820,205 | A | 6/1974 | Shaw | |
| 4,315,353 | A | 2/1982 | Sorensen | |
| 4,727,632 | A | 3/1988 | Yearsley | |
| 4,845,906 | A | 7/1989 | Turpin | |
| 4,922,590 | A | 5/1990 | Yearsley | |
| 5,497,819 | A * | 3/1996 | Chiang | B60J 11/00 150/166 |
| 6,918,163 | B2 | 7/2005 | Pace et al. | |
| 8,096,028 | B2 | 1/2012 | Bates | |
| D692,634 | S | 10/2013 | Torres | |
| 8,578,574 | B1 | 11/2013 | Smith | |
| 2014/0000075 | A1 * | 1/2014 | Catlett | A61G 17/04 27/14 |

FOREIGN PATENT DOCUMENTS

| | | | | |
|---|---|---|---|---|
| GB | 480382 A * | 2/1938 | | B62J 19/00 |
| WO | 2004100849 A2 | 11/2004 | | |

* cited by examiner

*Primary Examiner* — William Miller
(74) *Attorney, Agent, or Firm* — Barkume & Associates P.C.

(57) ABSTRACT

A two-piece casket containment system is provided that consist of an upper cover and lower base, both of which are made from a pliable, lightweight waterproof material, and both of which may be cinched around the casket through use of a drawstring assembly.

7 Claims, 4 Drawing Sheets

TWO-PIECE CASKET COVER FOR IN-GROUND BURIAL

TECHNICAL FIELD

The present invention is a casket cover for in-ground burial applications.

BACKGROUND OF THE INVENTION

Caskets are preferably buried with an enclosure that surrounds the casket and provides protection of the casket against natural elements such as moisture and dirt. The prior art in this field falls into two categories: (a) those that are intended for below ground interment, and (b) those that are intended for above ground entombment.

With regard to category (a), these protective coverings are mainly comprised basically of a box which is made of either concrete or steel into which the casket is placed, and then the lid seals the unit. The concrete vault is by far the most protective enclosure for a below ground interment followed by the steel vault enclosure. Both of these are expensive but do the job which they are supposed to do. However, the expense of these puts them out of reach of many grieving families who would like to have some sort of protection for the casket of their loved one. The present invention fills the gap in the marketplace where otherwise a casket would be just a bare casket burial with no extra protection for the casket, at a cost that is much more affordable than the concrete or steel alternatives.

With regard to category (b), primarily the reason for which these prior art solutions will fail for this application of below ground interments, is simply because all of these were designed for above ground entombment; i.e., the concepts of the prior art were not conceived with the intention of, and the ideas were subsequently not developed for the purpose of below ground interments but, most crucially, only for above ground entombments. For example, these might include a hermetic seal around the casket and a valve for the release of decomposition gases as the body decays; this is completely unnecessary for a below ground interment. Consequently, the materials used and the manufacture methods employed do not account for exposure to the elements, mainly moisture as water, and to the massive forces from the vast volume of soil/backfill materials placed upon them. The understanding of the aforementioned facts is imperative when comprehending the novelty of this invention.

The solution provided herein does not crack, rust, corrode, or absorb water, and it is completely undamaged by pressure. Thus, in conclusion, because of these advantages outside dirt and moisture cannot access the casket and it will remain uncompromised considerably longer than with no protection at all. Casket deterioration is, however, inevitable since moisture is already present inside the casket from the remains within. So therefore, in due course, the structure of the casket will collapse from the combined effect of internal moisture and the pressure from the earth above, but the bodily remains will still be free of dirt and excess water.

SUMMARY OF THE INVENTION

Provided is a burial casket containment system comprising an upper cover and a lower base. The upper cover comprises a pliable fabric comprising a top portion and four upper side portions, each of the four upper side portions adjoining the top portion along the perimeter of the top portion so as to form an upper opening suitable in shape for encasing the top of a burial casket. The upper cover further comprises an upper drawstring assembly encased in an upper channel along the upper opening perimeter formed by the four upper side portions.

The lower base comprises a pliable fabric comprising a bottom portion and four base side portions, each of the four base side portions adjoining the bottom portion along the perimeter of the bottom portion so as to form a lower opening suitable in shape for encasing the bottom of a burial casket. The lower base further comprises a base drawstring assembly in a lower channel encased along the base opening perimeter formed by the four base side portions.

Using this invention, when a burial casket is placed within the lower opening of the lower base, the base drawstring assembly is cinched so as to draw the base opening perimeter snugly around the burial casket, and when the upper opening of the upper cover is placed over the top of the burial casket so as to encase the burial casket and overlap the lower base, the upper drawstring assembly is cinched so as to draw the upper opening perimeter snugly around the burial casket and the lower base.

DETAILED DESCRIPTION OF THE PREFERRED EMBODIMENT

Figure 1:
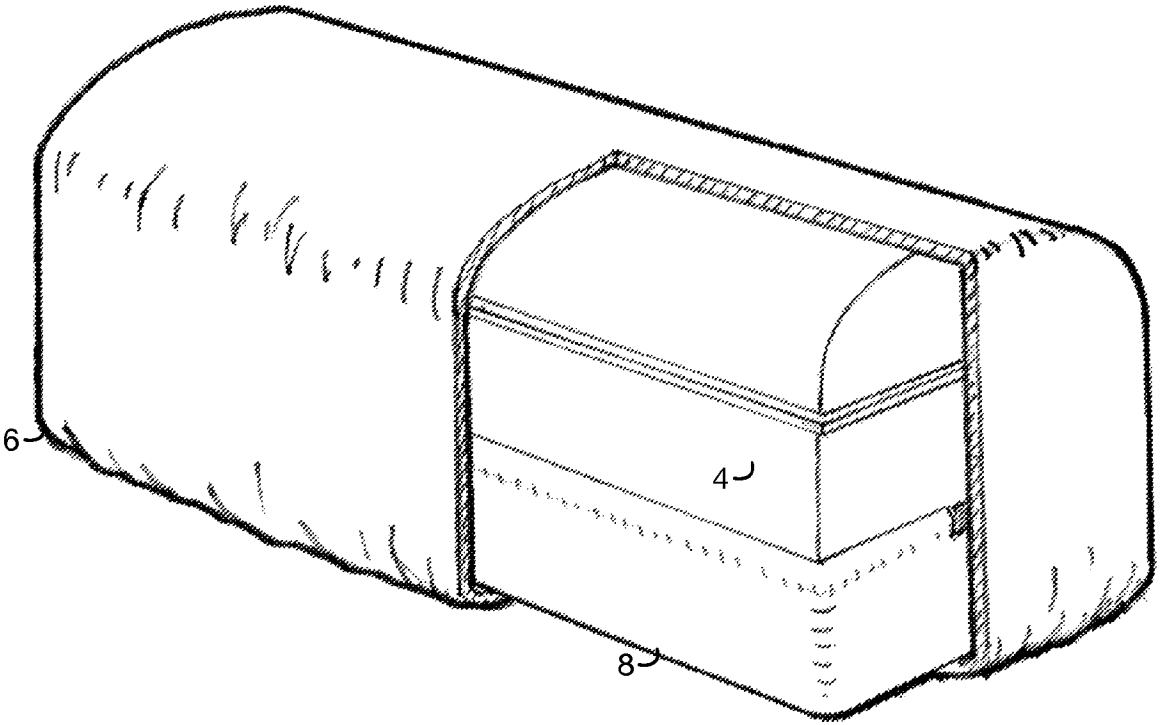
FIG. 1 illustrates the two-piece casket cover of the present invention assembled around a casket with part of the cover cut away to illustrate the casket inside.
Figure 2:
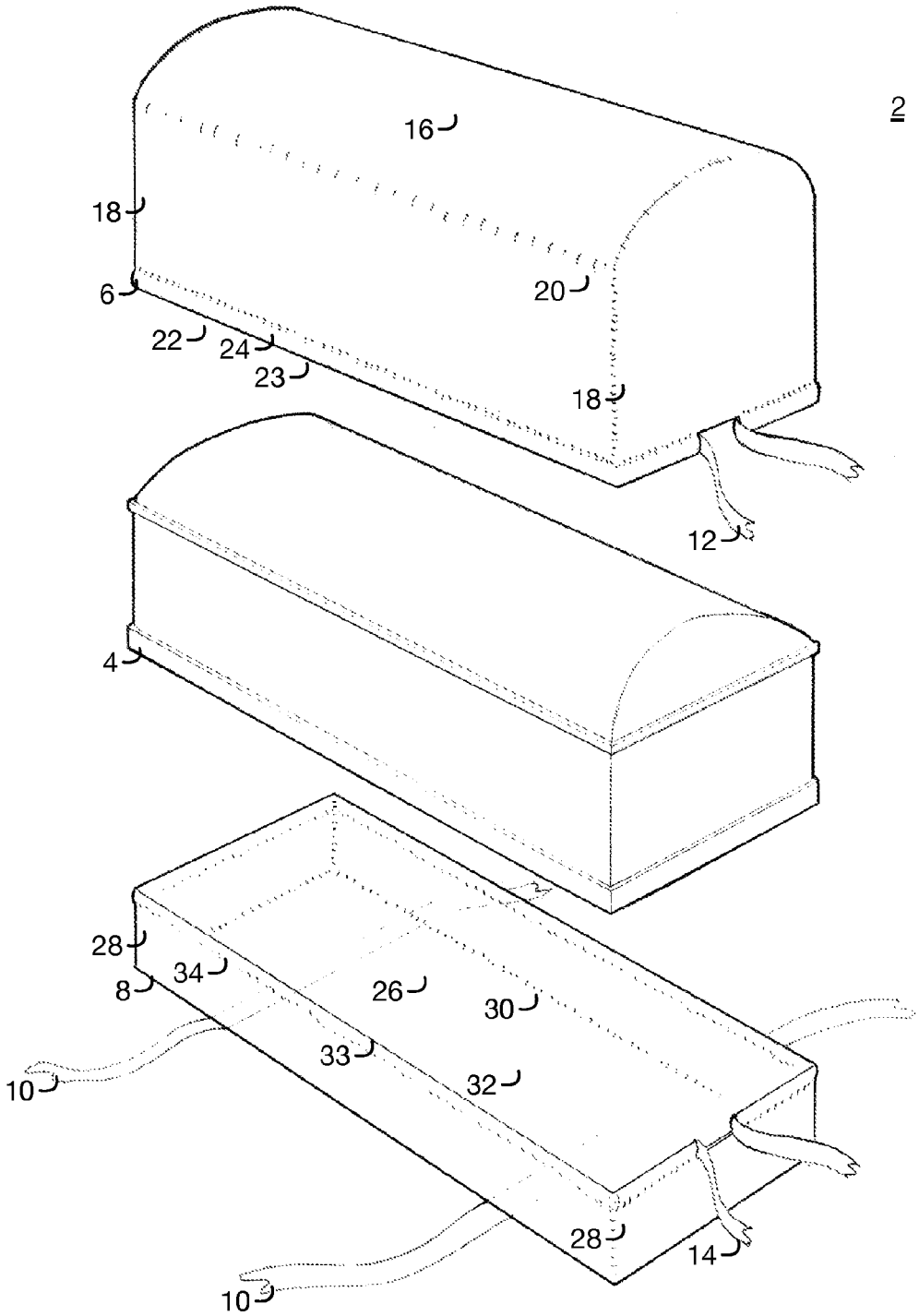
FIG. 2 illustrates the two-piece casket cover of my invention with respect to the casket prior to assembly.

With reference to the FIGS. 1 and 2, shown is the preferred embodiment of the present invention, which consists of a two-piece containment system 2 and a casket 4, which does not form part of the invention but is shown to illustrate the assembly and operation of the invention. The system 2 includes an upper cover 6 and lower casket containment base 8 to be used on below ground interments. This system is not intended to be air-tight; thus it is herein referred to as the containment unit. The upper cover 6 overlaps the lower base 8, each piece being retained onto the casket 4 by means of a drawstring assembly (upper drawstring assembly 12 on the upper cover 6 and base drawstring assembly 14 on the lower base 8, as shown).

The upper cover 6 is formed by adjoining a top portion 16 to four upper side portions 18. Each of the four upper side portions 18 adjoin the top portion 16 along the perimeter 20 of the top portion 16 so as to form an upper opening 22 suitable in shape for encasing the top of the burial casket 4. The upper cover 6 also has an upper drawstring assembly 12 encased in an upper channel 24 along the upper opening perimeter 23 formed by the four upper side portions 18.

The lower base 8 is formed by adjoining a bottom portion 26 to four base side portions 28. Each of the four base side portions 28 adjoin the bottom portion 26 along the perimeter 30 of the bottom portion so as to form a lower opening 32 suitable in shape for encasing the bottom of the burial casket 4. The lower base 8 also has a base drawstring assembly 14 encased in a lower channel 34 along the base opening perimeter 33 formed by the four base side portions 28.

Each of the drawstring assemblies 12, 14 is constructed of heavy-duty strapping material which concludes in an adjustable clip assembly (not shown). Any type of clip assembly may be used as known in the art, as long as it provides closure of the drawstring when cinched or tightened around the casket 4. For example, a two-piece plastic safety buckle may be used, or a VELCRO hook and loop assembly, etc.

In the alternative, a bungee cord may be used that may have hooks or other type of fastening mechanism on each end in order to be cinched snugly around the casket. Or, the bungee cord may be a one-piece assembly that is appropriately sized so as to expand over the casket and then cinch around it after assembly, if desired, similar to the operation of a rubber band.

The drawstring assembly 12 is secured to the upper cover 6 by means of the upper channel 24 that is shown by the dotted lines in the Figures, which may be formed by folding and then sewing the material against itself as known in the art, or by any equivalent manner. Likewise, the drawstring assembly 14 is secured to the lower base 8 by means of the lower channel 34 that is shown by the dotted lines in the Figures, which may be formed by folding and then sewing the material against itself as known in the art, or by any equivalent manner.

The upper cover 6 overlaps the lower base 8 and ensures that moisture cannot enter into the casket 4. The adjustable clips can be placed anywhere along the periphery of each of the containment covers 6, 8, securing the containment unit 2 firmly against the sides of the casket 4. Any gasses will be able to escape the containment unit 2 through the area where the two parts of the containment unit overlap. Since the cover 6 and base 8 are not hermetically sealed, there is no requirement for a pressure relief valve as may be necessary in the prior art.

The cover 6 and base 8 of the containment unit 2 are preferably manufactured from, but not limited to, a high tensile strength, abrasion resistant, water proof PVC coated polyester fabric, herein referred to as the fabric. Each of the cover 6 and base 8 may comprise multiple pieces of fabric that are joined together by means of heat-welding. This particular method of joining the separate fabric pieces of the cover 6 and the base 8 produces an exceedingly strong bond that is as strong as the fabric itself. The bonds are equally as strong and resistant to solids, liquids and gases. In the alternative to multiple pieces, the four upper side portions 18 and/or the four base side portions 28 may be replaced with a single piece of material that wraps around and is sealed to itself accordingly, and then mated to the top portion 16 and the bottom portion 26, respectively. That is, any combination of pieces of fabric may be used to form the upper cover 6 and/or the lower base 8 into the shapes as described herein.

The containment unit 2 is positioned on the casket at the cemetery at the time of burial. The lower base 8 of the unit is placed on the casket lowering device (not shown). Optionally, the lower base may be temporarily secured to the casket lowering device by means of the lowering device attachment straps 10. The casket 4 is then placed on top of the base 8 of the containment unit as shown in FIG. 2.

After services are completed, the base 8 of the containment unit 2 is folded up around the sides of the casket 4. The base 8 of the containment unit 2 is then fitted securely by the drawstring assembly 14 to the lower portion of the casket 4 (see FIGS. 3A-3C). Then, the upper cover 6 of the containment unit 2 is draped over the remaining portion of the exposed casket 4, overlapping the lower base 8. The upper cover 6 is then secured to the casket 4 using the drawstring assembly 12 located on the lower portion of the upper cover 6 as shown in FIG. 2 (see also FIGS. 4A-4F).

Figure 3A:
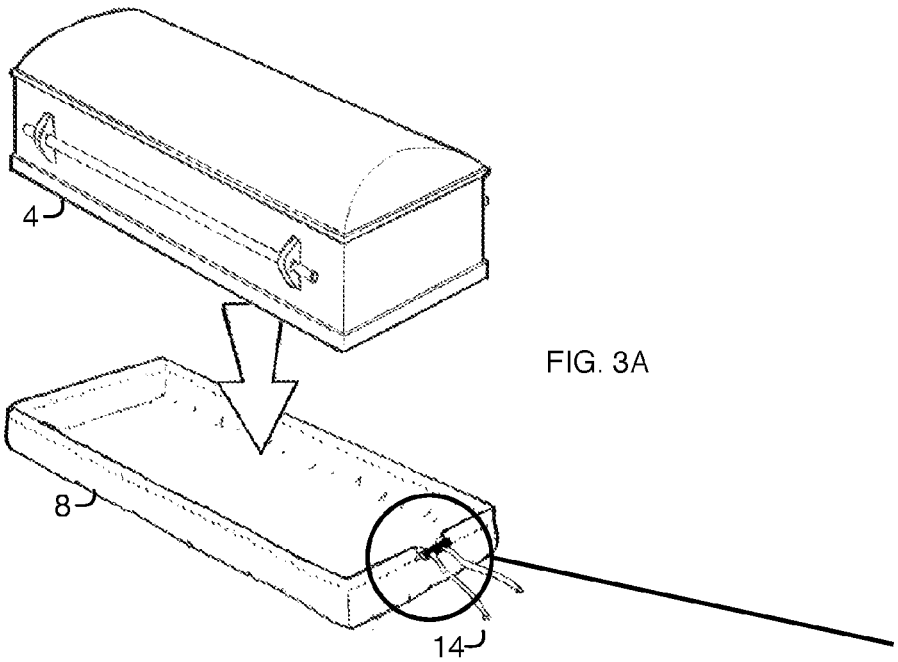
FIGS. 3A through 3C show the installation of the lower base.
Figure 3B:
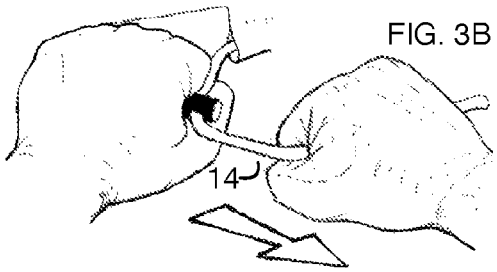
Figure 3C:
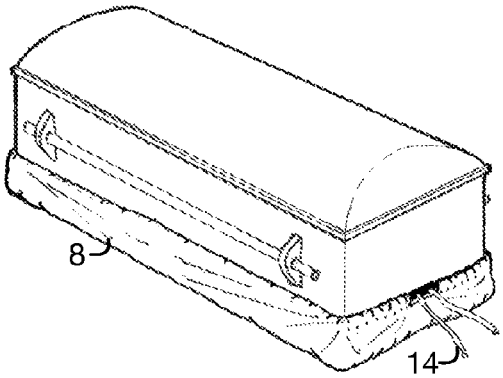
Figure 4A:
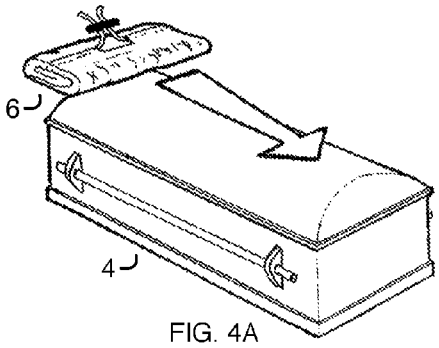
FIGS. 4A through 4F show the installation of the upper cover.
Figure 4D:
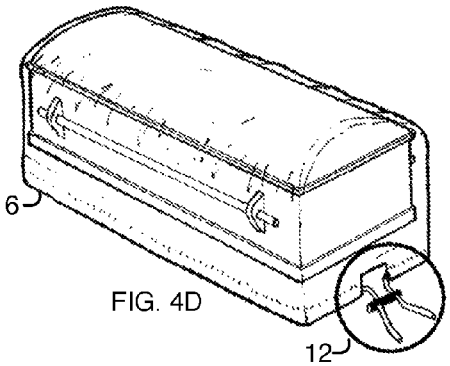
Figure 4B:
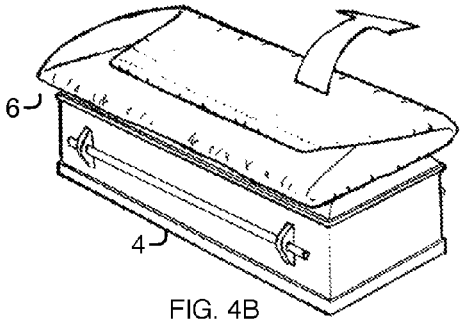
Figure 4E:
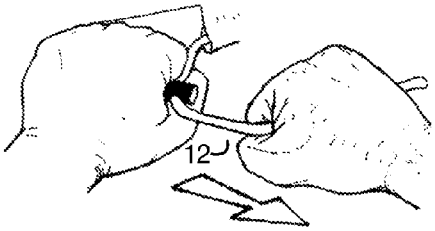
Figure 4C:
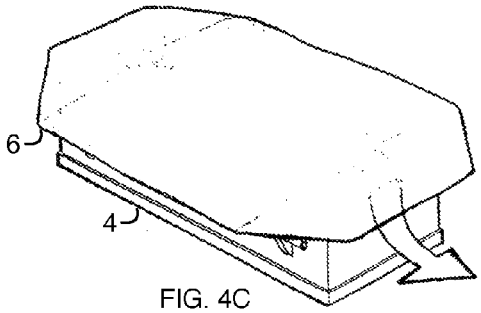
Figure 4F:
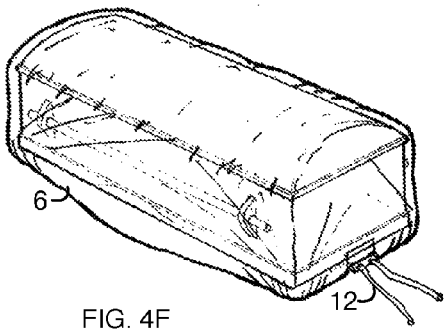

The containment unit 2 now completely encases the casket 4, as shown in FIG. 1. The containment covered casket is now ready to be lowered into the ground. FIGS. 3A through 3C show the installation of the lower base 8 as described. FIGS. 4A through 4F show the installation of the upper cover 6 as described (the lower base is not shown for purposes of clarity).

As can be seen, the present invention provides an inexpensive, lightweight and easy to manufacture containment unit for in-ground burial applications. The containment unit is easily stored and shipped due to the use of pliable yet sturdy materials. Since the cover and base employ the use of drawstrings, the cover and base need not be manufactured to fit precisely around the casket and thus may be used with various sized caskets.

I claim:

1. A burial casket containment system comprising an upper cover and a lower base;

the upper cover comprising a pliable fabric comprising a top portion and four upper side portions, each of the four upper side portions adjoining the top portion along the perimeter of the top portion so as to form an upper opening suitable in shape for encasing a top of a burial casket, the upper cover further comprising an upper drawstring assembly encased in an upper channel along the upper opening perimeter formed by the four upper side portions;

the lower base comprising a pliable fabric comprising a bottom portion and four base side portions, each of the four base side portions adjoining the bottom portion along the perimeter of the bottom portion so as to form a lower opening suitable in shape for encasing a bottom of the burial casket, the lower base further comprising a base drawstring assembly in a lower channel encased along the base opening perimeter formed by the four base side portions;

whereby, when the burial casket is placed within the lower opening of the lower base, the base drawstring assembly is cinched so as to draw the base opening perimeter snugly around the burial casket, and when the upper opening of the upper cover is placed over the top of the burial casket so as to encase the burial casket and overlap the lower base, the upper drawstring assembly is cinched so as to draw the upper opening perimeter snugly around the burial casket and the lower base.

2. The burial casket containment system of claim 1 wherein the upper drawstring assembly and the lower drawstring assembly each comprise a two piece buckle.

3. The burial casket containment system of claim 1 wherein the upper drawstring assembly and the lower drawstring assembly each comprise a hook and loop assembly.

4. The burial casket containment system of claim 1 wherein the pliable fabric of the upper cover and the lower cover comprises a water proof PVC coated polyester fabric.

5. The burial casket containment system of claim 1 wherein the four upper side portions adjoin the top portion along the perimeter of the top portion by heat welding.

6. The burial casket containment system of claim 1 wherein the four base side portions adjoin the bottom portion along the perimeter of the bottom portion by heat welding.

7. A method of covering a burial casket comprising the steps of:

placing the burial casket within a lower opening of a lower base, wherein the lower base comprises a pliable fabric comprising a bottom portion and four base side portions, each of the four base side portions adjoining the bottom portion along the perimeter of the bottom portion so as to form the lower opening suitable in shape for encasing a bottom of the burial casket, and wherein the lower base further comprises a base drawstring assembly in a lower channel encased along the base opening perimeter formed by the four base side portions;

cinching the base drawstring assembly so as to draw the base opening perimeter snugly around the burial casket;

placing an upper opening of an upper cover over a top of the burial casket so as to encase the burial casket and overlap the lower base, wherein the upper cover comprises a pliable fabric comprising a top portion and four upper side portions, each of the four upper side portions adjoining the top portion along the perimeter of the top portion so as to form the upper opening suitable in shape for encasing the top of the burial casket, and wherein the upper cover further comprises an upper drawstring assembly encased in an upper channel along the upper opening perimeter formed by the four side portions; and cinching the upper drawstring assembly so as to draw the upper opening perimeter snugly around the burial casket and the lower base.

* * * * *